US006325872B1

(12) United States Patent
Newton et al.

(10) Patent No.: US 6,325,872 B1
(45) Date of Patent: Dec. 4, 2001

(54) METHOD FOR MAKING BODY STOCK

(75) Inventors: William Newton, San Antonio; Jackie S. Ivy, New Braunfels, both of TX (US); Mark S. Selepack, Arvada, CO (US)

(73) Assignee: Nichols Aluminum-Golden, Inc., Houston, TX (US)

( * ) Notice: Subject to any disclaimer, the term of this patent is extended or adjusted under 35 U.S.C. 154(b) by 0 days.

(21) Appl. No.: 09/133,392

(22) Filed: Aug. 13, 1998

Related U.S. Application Data

(63) Continuation of application No. 08/713,080, filed on Sep. 12, 1996, now Pat. No. 5,833,775, which is a continuation-in-part of application No. 08/401,418, filed on Mar. 9, 1995, now Pat. No. 5,681,405.

(51) Int. Cl.[7] ..... C22F 1/04
(52) U.S. Cl. ..... 148/551; 148/552; 148/692
(58) Field of Search ..... 148/551, 552, 148/692, 696

(56) References Cited

U.S. PATENT DOCUMENTS

| | | | |
|---|---|---|---|
| 3,787,248 | 1/1974 | Setzer et al. | 148/11.5 |
| 3,930,895 | 1/1976 | Moser et al. | 148/2 |
| 4,028,141 | 6/1977 | Chia et al. | 148/2 |
| 4,111,721 | 9/1978 | Hitchler et al. | 148/2 |
| 4,151,013 | 4/1979 | Thompson et al. | 148/11.5 |
| 4,151,896 | 5/1979 | Nicoud et al. | 148/2 |
| 4,235,646 | 11/1980 | Neufeld et al. | 148/2 |
| 4,238,248 | 12/1980 | Gyöngyös et al. | 148/2 |
| 4,260,419 | 4/1981 | Robertson | 75/141 |
| 4,269,632 | 5/1981 | Robertson et al. | 148/2 |
| 4,282,044 | 8/1981 | Robertson et al. | 148/2 |
| 4,318,755 | 3/1982 | Jeffrey et al. | 148/11.5 |
| 4,334,935 | 6/1982 | Morris | 148/2 |
| 4,407,679 | 10/1983 | Manzonelli et al. | 148/2 |
| 4,411,707 | 10/1983 | Brennecke et al. | 148/2 |
| 4,424,084 | 1/1984 | Chisholm | 148/417 |
| 4,441,933 | 4/1984 | Boutin et al. | 148/2 |
| 4,498,523 | 2/1985 | Bowman et al. | 164/477 |
| 4,517,034 | 5/1985 | Merchant et al. | 148/439 |
| 4,526,625 | 7/1985 | Merchant et al. | 148/2 |
| 4,582,541 | 4/1986 | Dean et al. | 148/2 |
| 4,589,932 | 5/1986 | Park | 148/12.7 |
| 4,605,448 | 8/1986 | Baba et al. | 148/11.5 |
| 4,614,224 | 9/1986 | Jeffrey et al. | 164/476 |
| 4,614,552 | 9/1986 | Fortin et al. | 148/417 |
| 4,626,294 | 12/1986 | Sanders, Jr. | 148/11.5 |
| 4,637,842 | 1/1987 | Jeffrey et al. | 148/12.7 |
| 4,645,544 | 2/1987 | Baba et al. | 148/12.7 |
| 4,718,948 | 1/1988 | Komatsubara et al. | 148/2 |
| 4,753,685 | 6/1988 | Usui et al. | 148/2 |

(List continued on next page.)

FOREIGN PATENT DOCUMENTS

| | | | |
|---|---|---|---|
| 0485949A1 | 5/1992 | (EP) . | |
| 93304424.0 | 6/1993 | (EP) . | |
| 93304426.5 | 6/1993 | (EP) | C22F/1/04 |
| 4221036 | 8/1992 | (JP) . | |
| 4224651 | 8/1992 | (JP) . | |
| WO 90/10091 | 9/1990 | (WO) . | |
| WO 96/28582 | 9/1996 | (WO) . | |

OTHER PUBLICATIONS

Don McAuliffe, "Production of Continuous Cast Can Body Stock", Paper presented at AIME Meeting, Feb. 27, 1989, 7 pages.

*Primary Examiner*—George Wyszomierski
(74) *Attorney, Agent, or Firm*—Sheridan Ross P.C.

(57) ABSTRACT

An aluminum alloy sheet and a method for producing an aluminum alloy sheet. The aluminum alloy sheet is useful for forming into drawn and ironed container bodies. The sheet preferably has an after-bake yield strength of at least about 37 ksi and an elongation of at least about 2 percent. Preferably the sheet also has earing of less than about 2 percent.

24 Claims, 2 Drawing Sheets

U.S. PATENT DOCUMENTS

| | | | |
|---|---|---|---|
| 4,855,107 | 8/1989 | Teirlinck et al. | 420/546 |
| 4,861,388 | 8/1989 | Fortin et al. | 148/2 |
| 4,872,921 | 10/1989 | Teirlinck | 148/2 |
| 4,929,285 | 5/1990 | Zaidi | 148/692 |
| 4,976,790 | 12/1990 | McAuliffe et al. | 148/2 |
| 4,988,394 | 1/1991 | Cho | 148/12.7 |
| 5,061,327 | 10/1991 | Denzer et al. | 148/12.7 |
| 5,098,490 | 3/1992 | Huu | 148/12.7 |
| 5,104,459 | 4/1992 | Chen et al. | 148/11.5 |
| 5,104,465 | 4/1992 | McAuliffe et al. | 148/439 |
| 5,106,429 | 4/1992 | McAuliffe et al. | 148/552 |
| 5,110,545 | 5/1992 | McAuliffe et al. | 420/534 |
| 5,133,402 | 7/1992 | Ross | 164/431 |
| 5,156,683 | 10/1992 | Ross | 118/620 |
| 5,192,378 | 3/1993 | Doherty et al. | 148/691 |
| 5,356,495 | 10/1994 | Wyatt-Mair et al. | 148/551 |
| 5,469,912 | 11/1995 | McAuliffe | 164/476 |
| 5,470,405 | 11/1995 | Wyatt-Mair et al. | 148/551 |
| 5,496,423 | 3/1996 | Wyatt-Mair et al. | 148/551 |
| 5,514,228 | 5/1996 | Wyatt-Mair et al. | 148/551 |
| 5,681,405 | 10/1997 | Newton et al. | 148/551 |
| 5,833,775 * | 11/1998 | Newton et al. | 148/551 |
| 5,976,279 * | 11/1999 | Selepack et al. | 148/552 |

* cited by examiner

METHOD FOR MAKING BODY STOCK

CROSS-REFERENCE TO RELATED APPLICATIONS

The present application is a continuation of U.S. patent application Ser. No. 08/713,080 filed Sep. 12, 1996, now U.S. Pat. No. 5,833,775 which is a continuation-in-part of U.S. patent application Ser. No. 08/401,418 filed Mar. 9, 1995, now U.S. Pat. No. 5,681,405, the disclosures of which are incorporated herein by reference in their entirety.

FIELD OF THE INVENTION

The present invention relates generally to aluminum alloy sheet and methods for making aluminum alloy sheet. Specifically, the present invention relates to aluminum alloy sheet and methods for making aluminum alloy sheet wherein the sheet is particularly useful for forming into drawn and ironed container bodies.

BACKGROUND OF THE INVENTION

Aluminum beverage containers are generally made in two pieces, one piece forming the container sidewalls and bottom (referred to herein as a "container body") and a second piece forming the container top. Container bodies are formed by methods well known in the art. Generally, the container body is fabricated by forming a cup from a circular blank of aluminum sheet and then extending and thinning the sidewalls by passing the cup through a series of dies having progressively smaller bore size. This process is referred to as "drawing and ironing" the container body.

A common aluminum alloy used to produce container bodies is AA 3004, an alloy registered with the Aluminum Association. The physical characteristics of AA 3004 are appropriate for drawing and ironing container bodies due primarily to the relatively low magnesium (Mg) and manganese (Mn) content of the alloy. A desirable characteristic of AA 3004 is that the amount of work hardening imparted to the aluminum sheet during the can making process is relatively minor.

Aluminum alloy sheet is most commonly produced by an ingot casting process. In this process, the aluminum alloy material is initially cast into an ingot, for example having a thickness of from about 20 to 30 inches. The ingot is then homogenized by heating to an elevated temperature, which is typically 1075° F. to 1150° F., for an extended period of time, such as from about 6 to 24 hours. The homogenized ingot is then hot rolled in a series of passes to reduce the thickness of the ingot. The hot rolled sheet is then cold rolled to the desired final gauge.

Despite the widespread use of ingot casting, there are numerous advantages to producing aluminum alloy sheet by continuously casting molten metal. In a continuous casting process, molten metal is continuously cast directly into a relatively long thin slab and the cast slab is then hot rolled and cold rolled to produce a finished product. However, not all alloys can be readily cast using a continuous casting process into aluminum sheet that is suitable for forming operations, such as for making drawn and ironed container bodies.

Attempts have been made to continuously cast AA 3004 alloy. For example, in a paper entitled "Production of Continuous Cast Can Body Stock," which was presented by McAuliffe, an employee of the assignee of the present application, on Feb. 27, 1989, at the AIME meeting in Las Vegas, it is disclosed that limited testing was conducted with two manufacturers of 12 ounce, 90 pound cans (i.e., a minimum buckle strength of 90 p.s.i.). One test produced 3004 can stock. The paper discloses that "[b]oth tests, in the 2–3% earing range, verified that the surface and internal quality and structure were sufficient to produce cans of acceptable quality." However, it has been found that the continuously cast AA 3004 alloy is unsuitable for typical high carbonation beverages, such as soda, because it has insufficient buckle strength when employed using current typical stock gauges (e.g., from about 0.0112" to 0.0118") as opposed to stock gauges used at the time of the McAuliffe article (e.g., from about 0.0124" to 0.0128"). This is due to the poor after-bake characteristics of continuously cast AA 3004 alloy that is produced having suitable earing levels. This is discussed in more detail hereinafter in connection with examples of the physical characteristics of continuously cast AA 3004 alloy.

U.S. Pat. No. 4,238,248 by Gyongos et al. discloses casting an AA 3004 type alloy in a block casting apparatus. The alloy had a magnesium content from 0.8 to 1.3 percent and a manganese content from 1.0 to 1.5 percent, with up to 0.25 percent copper. As used throughout the present specification, all percentages refer to weight percent unless otherwise indicated. However, there is no disclosure of processing the cast strip into sheet suitable for container bodies.

U.S. Pat. No. 4,235,646 by Neufeld et al. describes the continuous casting of an AA 5017 aluminum alloy that is useful for beverage container bodies and container ends. The alloy includes 0.4 to 1.0 percent manganese, 1.3 to 2.5 percent magnesium and 0.05 to 0.4 percent copper. However, it is also disclosed that "copper and iron are included in the present composition due to their inevitable presence in consumer scrap. The presence of copper between 0.05 and 0.2 percent also enhances the low earing properties and adds to the strength of the present alloy." In Examples 1–3, the copper content of the alloys was 0.04 percent and 0.09 percent. In addition, the process includes a flash anneal step. In one example, the sheet stock disclosed by Neufeld et al. had a yield strength after cold rolling of 278 MPa (40.3 ksi) and an earing percentage of 1.2 percent.

U.S. Pat. No. 4,976,790 by McAuliffe et al. discloses a process for casting aluminum alloys using a block-type strip caster. The process includes the steps of continuously casting an aluminum alloy strip and thereafter introducing the strip into a hot mill at a temperature of from about 880° F. to 1000° F. (471° C.–538° C.). The strip is hot rolled to reduce the thickness by at least 70 percent and the strip exits the hot. roll at a temperature of no greater than 650° F. (343° C.). The strip is then coiled to anneal at 600° F. to 800° F. (316° C.–427° C.) and is then cold rolled, annealed and subjected to further cold rolling to optimize the balance between the 450 earing and the yield strength. The preferred annealing temperature after cold rolling is 695° F. to 705° F. (368° C.–374° C.).

U.S. Pat. No. 4,517,034 by Merchant et al. describes a method for continuously casting a modified AA 3004 alloy composition which includes 0.1 to 0.4 percent chromium. The sheet stock has an earing percentage of 3.12 percent or higher.

U.S. Pat. No. 4,526,625 by Merchant et al. also describes a method for continuously casting an AA 3004 alloy composition which is alleged to be suitable for drawn and ironed container bodies. The process includes the steps of continuously casting an alloy, homogenizing the cast alloy sheet at 950° F.–1150° F. (510° C.–621° C.), cold rolling the sheet, and annealing the sheet at 350° F.–550° F. (177° C.–288° C.) for a time of about 2–6 hours. The sheet is then cold rolled and reheated to recrystallize the grain structure at 600° F.–900° F. (316° C.–482° C.) for about 1–4 hours. The sheet is then cold rolled to final gauge. The reported earing for the sheet is about 3 percent or higher.

U.S. Pat. No. 5,192,378 by Doherty et al. discloses a process for making an aluminum alloy sheet useful for forming into container bodies. The aluminum alloy includes 1.1–1.7 percent magnesium, 0.5–1.2 percent manganese and 0.3–0.6 percent copper. The cast ingot is homogenized at 900° F.–1080° F. for about 4 hours, hot rolled, annealed at 500° F.–700° F., cold rolled and then annealed at 750–1050° F. The body stock can have a yield strength of 40–52 ksi after the final cold rolling.

U.S. Pat. No. 4,111,721 by Hitchler et al. discloses a process for continuously casting AA 3004 type alloys. The cast sheet is held at a temperature of at least about 900° F. (482° C.) for from about 4 to 24 hours prior to final cold reduction.

European Patent Application No. 93304426.5 discloses a method and apparatus for continuously casting aluminum alloy sheet. It is disclosed that an aluminum alloy having 0.93 percent manganese, 1.09 percent magnesium and 0.42 percent copper and 0.48 percent iron was cast into a strip. The composition was hot rolled in two passes and then solution heat treated continuously for 3 seconds at 1000° F. (538° C.), quenched and cold rolled to final gauge. Can bodies made from the sheet had an earing of 2.8 percent, a tensile yield strength of 43.6 ksi (301 MPa). An important aspect of the invention disclosed in European Patent Application No. 93304426.5 is that the continuously cast strip be subjected to solution heat treating immediately after hot rolling without. intermediate cooling, followed by a rapid quench. In fact, it is illustrated in Example 4 that strength is lost when the solution heat treatment and quenching steps of the invention are replaced with a conventional batch coil annealing cycle and cold working is limited to about 50 percent to maintain required earing, as is typical in continuous cast processes. Solution heat treating is disadvantageous because of the high capital cost of the necessary equipment and the increased energy requirements.

There remains a need for a process which produces an aluminum alloy sheet having sufficient strength and formability characteristics to be easily made into drawn and ironed beverage containers. The sheet stock should have good strength and elongation, and the resulting container bodies should have low earing.

It would be desirable to have a continuous aluminum casting process in which there is no need for a heat soak homogenization step. It would be advantageous to have a continuously cast process in which it is unnecessary to continuously anneal and solution heat treat the cast strip immediately following hot rolling (e.g., without intermediate cooling) followed by immediate quenching. It would be advantageous to have an aluminum alloy suitable for continuous casting in which the grain size is sufficient to provide for enhanced formability. It would be desirable to have an aluminum alloy suitable for continuous casting in which the magnesium level is kept low in order to achieve comparable brightness when compared to commercially available continuous cast can stock. It would be desirable to have an aluminum alloy suitable for continuous casting which can be formed into containers having suitable formability and having low earing and suitable strength.

SUMMARY OF THE INVENTION

In accordance with the present invention, a method is provided for fabricating an aluminum sheet product. The method includes the following steps. An aluminum alloy melt is formed which includes from about 0.7 to about 1.3 weight percent manganese, from about 1.0 to about 1.5 weight percent magnesium, from about 0.3 to about 0.6 weight percent copper, up to about 0.5 weight percent silicon, and from about 0.3 to about 0.7 weight percent iron, the balance being aluminum and incidental additional materials and impurities. In a preferred embodiment, the aluminum alloy melt includes from about 1.15 to about 1.45 weight percent magnesium and more preferably from about 1.2 to about 1.4 weight percent magnesium, from about 0.75 to about 1.2 weight percent manganese and more preferably from about 0.8 to about 1.1 weight percent manganese, from about 0.35 to about 0.5 weight percent copper and more preferably from about 0.38 to about 0.45 weight percent copper, from about 0.4 to about 0.65 weight percent iron and more preferably from about 0.50 to about 0.60 weight percent iron, and from about 0.13 to about 0.25 weight percent silicon, with the balance being aluminum and incidental additional materials and impurities. The alloy melt is continuously cast to form a cast strip and the cast strip is hot rolled to reduce the thickness and form a hot rolled strip. The hot rolled strip can be subsequently cold rolled without any intervening hot mill anneal step or can be annealed after hot rolling for at least about 0.5 hours at a temperature from about 700° F. to about 900° F. to form a hot mill annealed strip. The hot rolled strip or hot mill annealed strip is cold rolled to form a cold rolled strip wherein the thickness of the strip is reduced to the desired intermediate anneal gauge, preferably by about 35% to about 60% per pass. The cold rolled strip is annealed to form an intermediate cold mill annealed strip. The intermediate cold mill annealed strip is subjected to further cold rolling to reduce the thickness of the strip and form aluminum alloy strip stock.

In accordance with the present invention, aluminum alloy strip stock is provided comprising from about 0.7 to about 1.3 weight percent manganese, from about 1.0 to about 1.5 weight percent magnesium, from about 0.38 to about 0.45 weight percent copper, from about 0.50 to about 0.60 weight percent iron and up to about 0.5 weight silicon, with the balance being aluminum and incidental additional materials and impurities. The aluminum alloy strip stock is preferably made by continuous casting, Preferably, the strip stock has a final gauge after-bake yield strength of at least about 37 ksi, more preferably at least about 38 ksi and more preferably at least about 40 ksi. The strip stock preferably has an earing of less than 2 percent and more preferably less than 1.8 percent.

In accordance with the present invention, a continuous process for producing aluminum sheet is provided. In accordance with the process, relatively high reductions in gauge can be achieved in both the hot mill and cold mill. Additionally, due to the fact that greater hot mill and cold mill reductions are possible, the number of hot roll and cold roll passes can be reduced as compared to commercially available continuously cast can body stock. A relatively high proportion of cold work is needed to produce can body stock having acceptable physical properties according to the sheet production process of the present invention, as compared to commercially available continuously cast can body stock. Thus, a reduced amount of work hardening is imparted to the sheet when it is manufactured into items such as drawn and ironed containers, when compared to commercially available continuously cast can body stock.

In accordance with the present invention, the need for a high temperature soak (i.e., homogenization) can be avoided. When the high temperature homogenization step is performed when the metal is coiled, it can result in pressure welding such that it is impossible to unroll the coil. Also, the need for solution heat treatment after the hot mill (e.g., as disclosed in European Patent Application No. 93304426.5) can be avoided. By avoiding solution heat treatment, the continuous casting process is more economical and results in fewer process control problems.

In accordance with the present process, high amounts of recycled aluminum can be advantageously employed. For example, 75 percent and preferably up to 95 percent or more of used beverage containers (UBC) can be employed to produce the continuous cast sheet of the present invention. The use of increased amounts of UBC significantly reduces the cost associated with producing the aluminum sheet.

In accordance with the present invention, a continuous cast alloy is provided which includes relatively high levels of copper (e.g., 0.3 to 0.6 percent). It has surprisingly been found that the copper can be increased to these levels without negatively affecting the earing. If copper is increased in ingot cast processes, the resulting alloy can be too strong for can-making applications. In addition, in accordance with the present invention, relatively low levels of magnesium are used (e.g., 1.0 to 1.5 percent), leading to better can surface finish than commercially available continuously cast can body stock. For example, when drawn and ironed cans manufactured from aluminum sheet according to the present invention are subjected to industrial washing, less surface etching takes place and, therefore, a brighter can results. Also, the relatively low magnesium content decreases the work hardening rate. Also in accordance with the present invention, a relatively high iron content compared to commercially available continuous cast can body stock is employed to increase formability. It is believed that formability is increased because the increased iron changes the microstructure resulting in a finer grain material, when compared to a low iron content continuously cast material. The tolerance of these high iron levels also increases the amount of UBC that can be utilized, since iron is a common contaminant in consumer scrap.

In accordance with yet another embodiment of the present invention, a method is provided for fabricating an aluminum sheet product in which the initial cold rolling step is performed in the absence of an annealing step after hot rolling and before the first cold rolling step. An annealing step is performed after the first cold rolling step, and another annealing step is performed after the subsequent cold rolling step. The method includes the steps of:

(i) forming an aluminum alloy melt;

(ii) continuously casting the alloy melt to form a cast strip;

(iii) hot rolling the cast strip to form a hot rolled sheet;

(iv) cooling the hot rolled sheet to a temperature below the recrystallization temperature of the hot rolled sheet;

(v) cold rolling the hot rolled sheet to form a cold rolled sheet;

(vi) annealing the cold rolled sheet to form an intermediate cold mill annealed sheet; and (vii) further cold rolling the intermediate cold mill sheet to form a further cold rolled sheet;

(viii) further annealing the further cold rolled sheet to form a further cold mill annealed sheet;

(ix) further cold rolling the further cold mill annealed sheet to reduce the thickness of the sheet and form aluminum alloy sheet.

The elimination of the annealing step directly after the hot rolling step and the performance of two separate annealing steps only after cold rolling steps offer a number of advantages, particularly when the resulting sheet is employed in the fabrication of containers such as cans. The containers produced from the aluminum alloy sheet can have a reduced degree of earing and a reduction in the occurrence of split flanges and sidewalls in containers produced from the sheet. The plug diameter can be within an acceptable tolerance of the specified plug diameter. Containers produced from the sheet can have a significantly reduced incidence of bulging in the container necked/flange sidewalls compared to containers produced from aluminum alloy sheet having different compositions and/or produced by other processes. It is believed that the alloy sheet of the present invention typically experiences less work hardening during fabrication of containers from the sheet than other continuously cast alloys and comparable to direct chill or ingot cast sheet. For instance, work hardening can occur when cans come off the canmaker and are heated to elevated temperatures to dry the paint on the can. Finally, the annealing of a thinner gauge of sheet (i.e., annealing which is performed only after cold rolling steps) compared to annealing in previous embodiments (i.e., which is performed after casting and before hot rolling and again after cold rolling) increases the amount of reduction which can be satisfactorily achieved with each cold roll pass and thus can eliminate one or more cold rolling passes relative to previous embodiments.

The aluminum alloy sheet produced by the above-described method can have a number of desirable properties, especially for can making applications. By way of example, the sheet can have an as-rolled ultimate tensile strength of at least about 42.5 ksi; an as-rolled yield tensile strength of at least about 38.5 ksi; an earing ranging of no more than about 2.0%; and/or an as-rolled elongation of more than about 4%.

While not wishing to be bound by any theory, it is believed that the cold rolling of the hot rolled sheet before the first annealing step to inhibit the realization of full hard properties in the sheet during fabrication is an important factor in the improved properties, particularly reduced earing. Prior art processes employ an annealing step following hot rolling and before the first cold rolling step and another annealing step after one or more cold rolling steps and typically before cold rolling to form the finished aluminum alloy sheet. The percent reduction in the gauge of the sheet from cold rolling between the hot mill and cold mill annealing steps in the prior art continuous casting processes is significantly more than the percent reduction in sheet gauge between the cold mill annealing steps in the process of the present invention which can cause the sheet to have full hard properties. In contrast, the present invention maintains total cold mill reductions before the first anneal step, between the first and second anneal steps, and after the second anneal step to no more than about 60% to prevent the sheet from acquiring full hard properties. Because of the relatively fine grain size of continuously cast sheet compared to direct chill cast sheet, continuously cast sheet has a significantly higher rate of increase in earing for a given percent reduction in the cold mill. The use of the first and second annealing steps after cold milling decreases the earing to a relatively low figure and thereby maintains the sheet properties below the full hard properties. The placement of the first annealing step following cold rolling and not hot rolling is contrary to conventional metallurgical wisdom which teaches that the annealing and softening of the metal before cold milling is performed places the metal in a more uniform condition for the cold milling.

In another embodiment of the present invention, aluminum alloy sheet includes (a) from about 0.7 to about 1.3 wt % manganese; (b) from about 1.0 to about 1.6 wt % magnesium; (c) from about 0.3 to about 0.6 wt % copper; (d) no more than about 0.5 wt % silicon; and (e) from about 0.3 to about 0.7 wt % iron. The balance is aluminum and incidental additional materials and impurities. This alloy is particularly useful for aluminum alloy sheet fabricated by any of the above processes.

In another embodiment of the present invention, aluminum alloy comprises (a) from about 1.05 to about 1.07 wt % manganese, (b) from about 1.35 to about 1.50 wt % magnesium, (c) from about 0.45 to about 0.55 wt % copper, (d) from about 0.39 to about 0.45 wt % silicon, and (e) from about 0.55 to about 0.60 wt % iron, with the balance being aluminum and incidental additional materials and impurities. The aluminum alloy sheet is preferably made by continuous casting and more preferably by any of the processes described above. Preferably, the sheet has an after-bake yield tensile strength of at least about 37.0 ksi, more preferably at least about 38.0 ksi and more preferably at least about 39.0 ksi. The sheet preferably has an earing of less than about 2.0%, more preferably less than about 1.8% and most preferably no more than about 1.6%. The sheet preferably has an elongation of more than about 4% and more preferably more than about 4.5%. Finally, the sheet preferably has an after-bake ultimate tensile strength of at least about 42.5 ksi, more preferably at least about 43.0 ksi and more preferably at least about 43.5 ksi.

The aluminum alloy sheet of this embodiment can provide several advantages relative to aluminum alloy sheet having other compositions, especially in the fabrication of containers. The physical properties of the sheet of this embodiment can experience significantly less reduction during fabrication relative to the reduction in physical properties of other alloy sheets during fabrication. In canmaking applications, for example, existing continuously cast alloy sheets can suffer a reduction in physical properties of as much as 4 lbs or more in buckle strength and 20 lbs or more in column strength, after heating the sheet in deco/IBO ovens.

DETAILED DESCRIPTION

Figure 1:
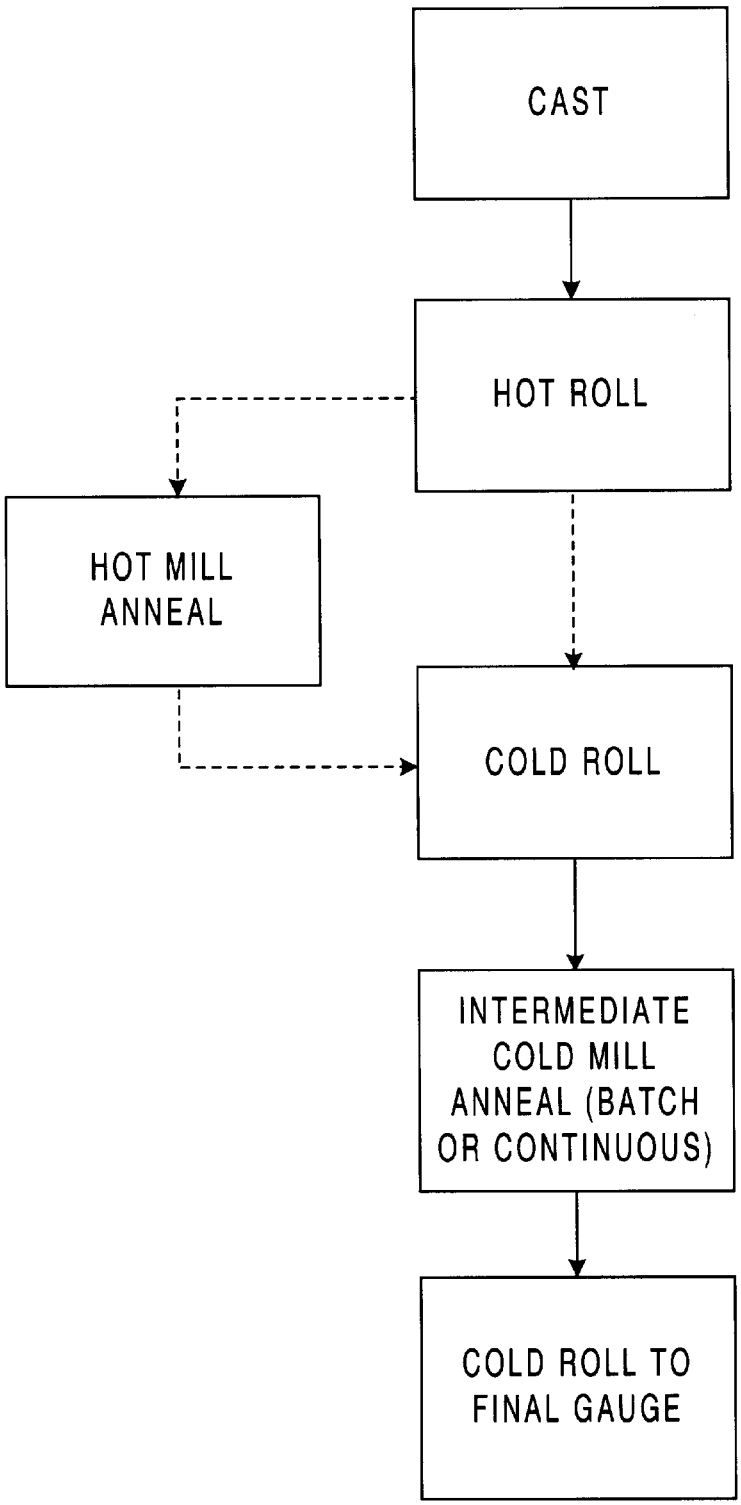
FIG. 1 is a block diagram illustrating one embodiment of process of the present invention.

In accordance with the present invention, aluminum sheet having good strength and forming properties is provided. In addition, a process for producing aluminum sheet is also provided. The resulting aluminum sheet is particularly suitable for the fabrication of drawn and ironed articles, such as containers. The resulting sheet has reduced earing and improved strength in thinner gauges than comparable sheet fabricated according to the prior art.

The preferred aluminum alloy composition according to the present invention includes the following constituents: (1) manganese, preferably with a minimum of at least about 0.7 percent manganese and more preferably with a minimum of at least about 0.75 percent manganese and more preferably with a minimum of at least about 0.8 percent manganese, and preferably with a maximum of at most about 1.3 percent manganese and more preferably with a maximum of at most about 1.2 percent manganese and more preferably with a maximum of at most about 1.1 percent manganese; (2) magnesium, preferably with a minimum of at least about 1.0 percent magnesium and more preferably with a minimum of at least about 1.15 percent magnesium and more preferably with a minimum of at least about 1.2 percent magnesium, and preferably with a maximum of at most about 1.5 percent magnesium and more preferably with a maximum of at most about 1.45 percent magnesium and more preferably with a maximum of at most about 1.4 percent magnesium; (3) copper, preferably with a minimum of at least about 0.3 percent copper and more preferably with a minimum of at least about 0.35 percent copper and more preferably with a minimum of at least about 0.38 percent copper, and preferably with a maximum of at most about 0.6 percent copper and more preferably with a maximum of at most about 0.5 percent copper and more preferably with a maximum of at most about 0.45 percent copper; (4) iron, preferably with a minimum of at least about 0.3 percent iron and more preferably with a minimum of at least about 0.4 percent iron and more preferably with a minimum of at least about 0.50 percent iron, and preferably with a maximum of at most about 0.7 percent iron and more preferably with a maximum of at most about 0.65 percent iron and more preferably with a maximum of at most about 0.60 percent iron; (5) silicon, preferably with a minimum of 0 percent silicon and more preferably with a minimum of at least about 0.13 percent silicon, and preferably with a maximum of at most about 0.5 percent silicon and more preferably with a maximum of at most about 0.25 percent silicon. The balance of the alloy composition consists essentially of aluminum and incidental additional materials and impurities. The incidental additional materials and impurities are preferably limited to about 0.05 weight percent each, and the sum total of all incidental additional materials and impurities preferably does not exceed about 0.15 percent.

While not wishing to be bound by any theory, it is believed that the copper content of the alloy composition according to the present invention, particularly in combination with the process steps discussed below, contributes to the increased strength of the aluminum alloy sheet stock while maintaining acceptable elongation and earing characteristics. Additionally, it is believed that the relatively low level of magnesium results in a brighter finish in containers manufactured from the alloy of the present invention, due to a decrease in surface etching, when compared to currently commercially available continuously cast stock. Furthermore, it is believed that the relatively high level of iron leads to increased formability because the iron changes the microstructure resulting in a finer grain material when compared to continuous cast materials cast with similar levels of manganese, copper and magnesium and, having lower levels of iron.

According to a preferred embodiment of the present invention, a continuous casting process is used to form an aluminum alloy melt into an aluminum alloy sheet product. The continuous casting process which is shown in FIG. 1 can employ a variety of continuous casters, such as a belt caster or a roll caster. Preferably, the continuous casting process includes the use of a block caster for casting the aluminum alloy melt into a sheet. The block caster is preferably of the type disclosed in U.S. Pat. Nos. 3,709,281; 3,744,545; 3,747,666; 3,759,313 and 3,774,670 all of which are incorporated herein by reference in their entirety.

According to this embodiment of the present invention, a melt of the aluminum alloy composition described above is formed. The alloy composition according to the present invention can be formed in part from scrap material such as plant scrap, can scrap and consumer scrap. Plant scrap can include ingot scalpings, rolled strip slicings and other alloy trim produced in the mill operation. Can scrap can include scrap produced as a result of earing and galling during can manufacture. Consumer scrap can include containers recycled by users of beverage containers. It is preferred to maximize the amount of scrap used to form the alloy melt and preferably the alloy composition according to the present invention is formed with at least about 75 percent and preferably at least about 95 percent total scrap.

In order to come within the preferred elemental ranges of the present alloy, it is necessary to adjust the melt. This may be carried out by adding elemental metal, such as magnesium or manganese, or by adding unalloyed aluminum to the melt composition to dilute excess alloying elements.

The metal is charged into a furnace and is heated to a temperature of about 1385° F. to thoroughly melt the metal. The alloy is treated to remove materials such as dissolved hydrogen and non-metallic inclusions which would impair casting of the alloy and the quality of the finished sheet. The alloy can also be filtered to further remove non-metallic inclusions from the melt.

The melt is then cast through a nozzle and into the casting cavity. The nozzle is typically fabricated from a refractory material and provides a passage from the melt to the caster wherein the molten metal is constrained by a long narrow tip upon exiting the nozzle. For example, a nozzle tip having a thickness of from about 10 to about 25 millimeters and a width of from about 254 millimeters to about 2160 millimeters can be used. The melt exits the tip and is received in a casting cavity formed by opposite pairs of rotating chill blocks.

The metal cools as it travels within the casting cavity and solidifies by transferring heat to the chill blocks until the strip exits the casting cavity. At the end of the casting cavity, the chill blocks separate from the cast strip and travel to a cooler where the chill blocks are cooled. The rate of cooling as the cast strip passes through the casting cavity of the casting apparatus is a function of various process and product parameters. These parameters include the composition of the material being cast, the strip gauge, the chill block material, the length of the casting cavity, the casting speed and the efficiency of the block cooling system.

It is preferred that the cast strip exiting the block caster be as thin as possible to minimize subsequent working of the strip. Normally, a limiting factor in obtaining minimum strip thickness is the thickness and width of the distributor tip of the caster. In the preferred embodiment of the present invention, the strip is cast at a thickness of from about 12.5 millimeters to about 25.4 millimeters and more preferably about 19 millimeters.

Upon exiting the caster, the cast strip is then subjected to hot rolling in a hot mill. A hot mill includes one or more pairs of oppositely rotating rollers having a gap therebetween that reduce the thickness of the strip as it passes through the gap. The cast strip preferably enters the hot mill at a temperature in the range of from about 850° F. to about 1050° F. According to the process of the present invention, the hot mill preferably reduces the thickness of the strip by at least about 70 percent and more preferably by at least about 80 percent. In a preferred embodiment, the hot mill includes 2 pairs of hot rollers and the percentage reduction in the hot mill is maximized. The hot rolled strip preferably exits the hot mill at a temperature in the range from about 500° F. to about 750° F. In accordance with the present invention, it has been found that a relatively high reduction in gauge can take place in each pass of the hot rollers and therefore the number of pairs of hot rollers can be minimized.

The hot rolled strip is optionally annealed to remove any residual cold work resulting from the hot mill operation and to reduce the earing. Preferably, the hot rolled strip is annealed in a hot mill anneal step at a temperature of a minimum of at least about 700° F. and more preferably a minimum of at least about 800° F., and preferably with a maximum temperature of at most about 900° F. and more preferably a maximum temperature of at most about 850° F. According to one embodiment, a preferred temperature for annealing is about 825° F. The entire metal strip should preferably be at the annealing temperature for at least about 0.5 hours, more preferably at least about 1 hour and more preferably at least about 2 hours. The amount of time that the entire metal strip should be at the annealing temperature should preferably be a maximum of at most about 5 hours, more preferably a maximum of at most about 4 hours. In a preferred embodiment, the anneal time is about 3 hours. For example, the strip can be coiled, placed in an annealing furnace, and held at the desired anneal temperature for from about 2 to about 4 hours. This length of time insures that interior portions of the coiled strip reach the desired annealing temperature and are held at that temperature for the preferred period of time. It is to be expressly understood that the annealing times listed above are the times for which the entire metal strip is maintained at the annealing temperatures, and these times do not include the heat-up time to reach the anneal temperature and the cool-down time after the anneal soak. The coiled strip is preferably cooled expeditiously to allow further processing, but is not rapidly quenched to retain a solution heat treated structure.

Alternatively, the hot rolled strip is not subjected to a hot mill anneal step. In this alternative embodiment, the hot rolled strip is allowed to cool and is subsequently subjected to cold rolling without any intermediate thermal treatment. It is to be expressly understood that the hot rolled strip is not subjected to a heat soak homogenization, nor is it subjected to a solution heat treatment followed by a rapid quench. The strip is cooled in the manner that is most convenient.

After the hot mill annealed or hot rolled sheet has cooled to ambient temperature, it is cold rolled in a first cold rolling step to an intermediate gauge. Preferably, cold rolling to intermediate gauge includes the step of passing the sheet between one or more pairs of rotating cold rollers (preferably 1 to 3 pairs of cold rollers) to reduce the thickness of the strip by from about 35 percent to about 60 percent per pass through each pair of rollers, more preferably by from about 45 percent to about 55 percent per pass. The total reduction in thickness is preferably from about 45 to about 85 percent. In accordance with the process of the present invention, it has been found that a relatively large reduction in the gauge of the aluminum sheet can take place in each pass as compared to a commercially available continuously cast can stock. In this manner, it is possible to reduce the number of passes required in the cold mill.

When the desired intermediate anneal gauge is reached following the first cold rolling step, the sheet is intermediate cold mill annealed to reduce the residual cold work and lower the earing. Preferably, the sheet is intermediate cold mill annealed at a minimum temperature of at least about 600° F., more preferably at a minimum temperature of at least about 650° F., and preferably at a maximum temperature of no more than about 900° F. and more preferably at a maximum temperature of no more than about 750° F. According to one embodiment, a preferred annealing temperature is about 705° F. The anneal time is preferably a minimum of at least about 0.5 hours and is more preferably a minimum of at least about 2 hours. According to one embodiment of the present invention, the intermediate cold mill anneal step can include a continuous anneal, preferably at a temperature of from about 800° F. to about 1050° F. and more preferably at a temperature of about 900° F. It has unexpectedly been found that these cold mill annealing temperatures lead to advantageous properties.

After the cold rolled and intermediate cold mill annealed sheet has cooled to ambient temperature, a final cold rolling step is used to impart the final properties to the sheet. The preferred final cold work percentage is that point at which a balance between the ultimate tensile strength and the earing is obtained. This point can be determined for a particular alloy composition by plotting the ultimate tensile strength and earing values against the cold work percentage. Once this preferred cold work percentage is determined for the final cold rolling step, the gauge of the sheet during the intermediate annealing stage and, consequently, the cold work percentage for the first cold roll step can be determined and the hot mill gauge can be optimized to minimize the number of passes.

In a preferred embodiment the reduction to final gauge is from about 45 to about 80 percent, preferably in one or two passes of from about 25 to about 65 percent per pass, and more preferably a single pass of 60 percent reduction. When the sheet is fabricated for drawn and ironed container bodies, the final gauge can be, for example, from about 0.0096 inches to about 0.015 inches.

An important aspect of the present invention is that the aluminum sheet product that is produced in accordance with the present invention can maintain sufficient strength and formability properties while having a relatively thin gauge. This is important when the aluminum sheet product is utilized in making drawn and ironed containers. The trend in the can-making industry is to use thinner aluminum sheet stock for the production of drawn and ironed containers, thereby producing a container containing less aluminum and having a reduced cost. However, to use thinner gauge aluminum sheet stock the aluminum sheet stock must still have the required physical characteristics, as described in more detail below. Surprisingly, a continuous casting process has been discovered which, when utilized with the alloys of the present invention, produces an aluminum sheet stock that meets the industry standards.

The aluminum alloy sheet produced according to the preferred embodiment of the present invention is useful in a number of applications including, but not limited to, drawn and ironed container bodies. When the aluminum alloy sheet is to be fabricated into drawn and ironed container bodies, the alloy sheet preferably has an after-bake yield strength of at least about 37 ksi, more preferably at least about 38 ksi, and more preferably at least about 40 ksi. After-bake yield strength refers to the yield strength of the aluminum sheet after being subjected to a temperature of about 400° F. for about 10 minutes. This treatment simulates conditions experienced by a container body during post-formation processing, such as the washing and drying of containers, and drying of films or paints applied to the container. Preferably, the as rolled yield strength is at least 38 ksi and more preferably at least 39 ksi, and preferably is not greater than about 44 ksi and more preferably is not greater than about 43 ksi. The aluminum sheet preferably has an after bake ultimate tensile strength of at least about 40 ksi, more preferably at least about 41.5 ksi and more preferably at least about 43 ksi. The as rolled ultimate tensile strength is preferably at least 41 ksi and more preferably at least 42 ksi and more preferably at least 43 ksi, and preferably, not greater than 46 ksi and more preferably not greater than 45 ksi and more preferably not greater than 44.5 ksi.

To produce acceptable drawn and ironed container bodies, aluminum alloy sheet should have a low earing percentage. A typical measurement for earing is the 45° earing or 45° rolling texture. Forty-five degrees refers to the position on the aluminum sheet which is 45° relative to the rolling direction. The value for the 45° earing is determined by measuring the height of the ears which stick up in a cup, minus the height of valleys between the ears. The difference is divided by the height of the valleys times 100 to convert to a percentage.

Preferably, the aluminum alloy sheet, according to the present invention, has a tested earing of less than about 2 percent and more preferably less than about 1.8 percent. Importantly, the aluminum alloy sheet product produced in accordance with the present invention should be capable of producing commercially acceptable drawn and ironed containers. Therefore, when the aluminum alloy sheet product is converted into container bodies, the earing should be such that the bodies can be conveyed on the conveying equipment and the earing should not be so great as to prevent acceptable handling and trimming of the container bodies.

In addition, the aluminum sheet should have an elongation of at least about 2 percent and more preferably at least about 3 percent and more preferably at least about 4 percent. Further, container bodies fabricated from the alloy of the present invention having a minimum dome reversal strength of at least about 88 psi and more preferably at least about 90 psi at current commercial thickness.

In yet another embodiment of the present invention, a process and alloy composition for producing aluminum alloy sheet having good strength and forming properties is provided. As in the previous embodiment, the resulting aluminum alloy sheet is particularly suitable for the fabrication of drawn and ironed articles, such as containers. The resulting sheet can have reduced earing and improved strength in thinner gauges relative to comparable sheet fabricated according to the prior art.

The composition of the aluminum alloy sheet is important to realize these desirable properties. In one embodiment, the aluminum alloy composition includes the following constituents:

(i) manganese, preferably with a minimum of at least about 0.7 wt % manganese and more preferably with a minimum of at least about 1.05 wt % manganese, and preferably with a maximum of at most about 1.3 wt % manganese and more preferably with a maximum of at most about 1.07 wt % manganese;

(ii) magnesium, preferably with a minimum of at least about 1.0 wt % magnesium and more preferably with a minimum of at least about 1.35 wt % magnesium and preferably with a maximum of at most about 1.6 wt % magnesium and more preferably with a maximum of at most about 1.50 wt % magnesium;

(iii) copper, preferably with a minimum of at least about 0.3 wt % copper and more preferably with a minimum of at least about 0.45 wt % copper, and preferably with a maximum of at most about 0.6 wt % copper and more preferably with a maximum of at most about 0.50 wt % copper;

(iv) iron, preferably with a minimum of at least about 0.3 wt % iron and more preferably with a minimum of at least about 0.55 wt % iron and preferably with a maximum of at most about 0.7 wt % iron and more preferably with a maximum of at most about 0.60 wt % iron; and (v) silicon, preferably of no more than about 0.5 wt % silicon and more preferably with a minimum of at least about 0.39 wt % silicon, and a maximum of at most about 0.45 wt % silicon.

The balance of the alloy composition consists essentially of aluminum and incidental additional materials and impurities. The incidental additional materials and impurities are preferably limited to about 0.05 wt % each, and the sum total of all incidental additional materials and impurities preferably does not exceed about 0.15 wt %.

The alloy composition differs from prior art compositions in a number of respects. By way of example, the alloy has relatively high magnesium, copper, iron, and silicon content. While not wishing to be bound by any theory, it is believed that the high magnesium, copper, and iron content significantly enhance the sheet's yield and tensile strengths, and the silicon content causes alpha transformation particles to be larger. The use of larger alpha phase particles reduces galling and scoring of containers by inhibiting the accumulation of metal residue on the canmaking dies. Copper not only increases strength properties but also retards after-bake property drops. Iron increases strength properties and maintains a desired grain size.

Figure 2:
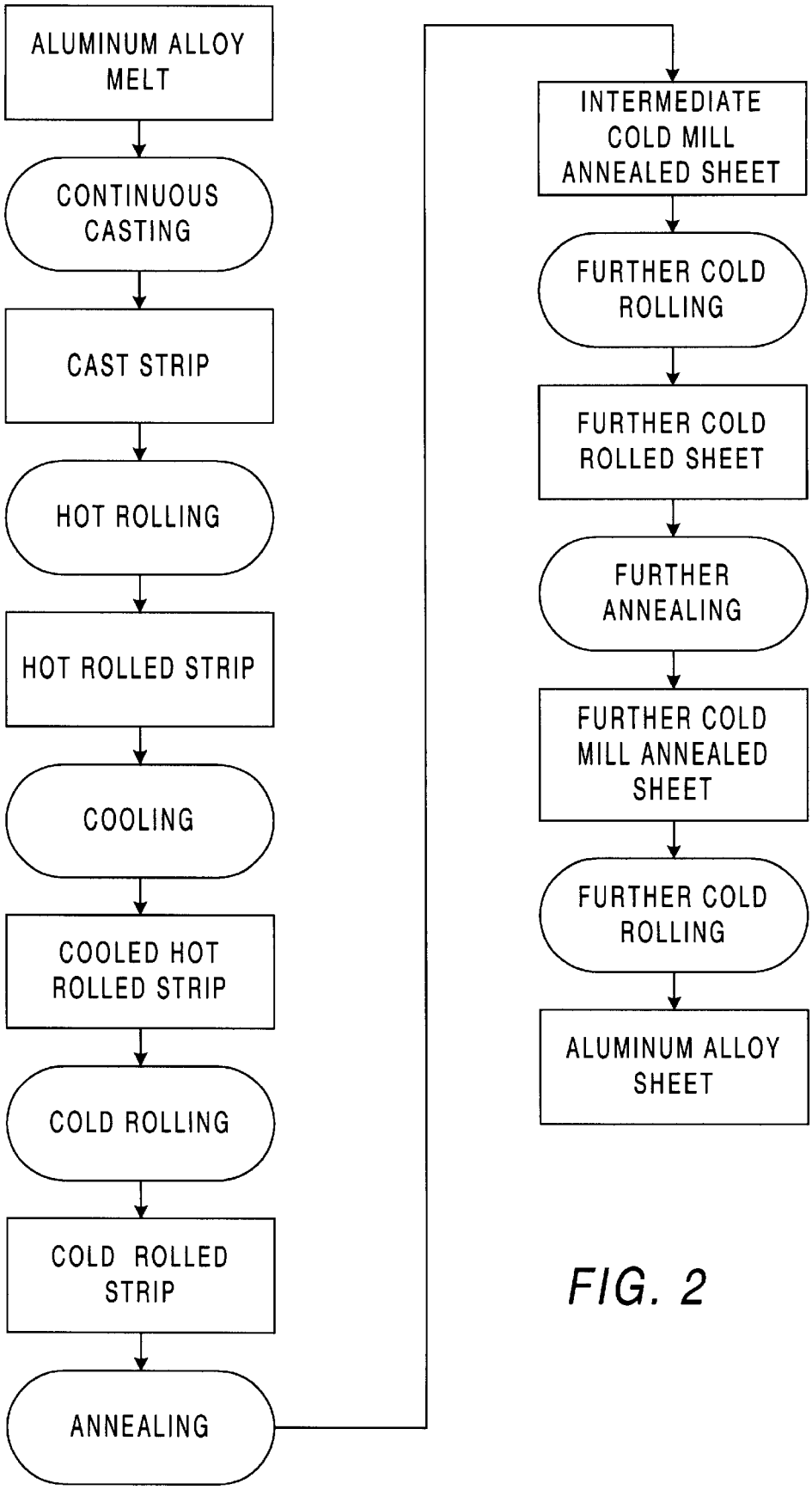
FIG. 2 is a block diagram illustrating another embodiment of a process of the present invention.

With continuing reference to FIG. 2, in the process a cast strip is produced in a casting cavity (e.g., a block caster, a belt caster, a twin-roll caster, etc.) and subjected to hot milling as described previously to form the hot rolled sheet. The hot mill preferably reduces the thickness of the cast strip in one or more passes by at least about 70% and more preferably by at least about 80%. The gauge of the cast strip preferably ranges from about 0.50 inches to about 0.75 inches while the gauge of the hot rolled sheet ranges from about 0.060 to about 0.110 inches. The hot rolled sheet preferably exits the hot mill at a temperature ranging from about 500 to about 750° F. It is preferred that the total reduction of the cast strip be realized in two to three passes with two passes being most preferred.

The hot rolled sheet passes directly to a cooling step before the first cold rolling step. The hot rolled sheet is allowed to cool before cold rolling to a temperature less than the recrystallization temperature of the hot rolled sheet. Preferably, the hot rolled sheet is allowed to cool for a sufficient period of time to produce a hot rolled sheet having a temperature ranging from about 75 to about 140° F. Generally, the hot rolled sheet is about 48 hours. The sheet is preferably not quenched or otherwise solution heat treated.

In the cold rolling step, the cooled hot rolled sheet is passed between cold rollers, as necessary, to form a cold rolled sheet at an intermediate gauge. Preferably, the intermediate gauge ranges from about 0.050 to about 0.080 inches and more preferably from about 0.055 to about 0.075 inches. It is preferred that the thickness of the sheet be reduced in total by less than 65%, more preferably by from about 35% to about 60%, and most preferably by from about 30% to about 55% through the cold rollers. It is preferred that the total sheet reduction be realized in two passes or less, with a single pass being most preferred.

When the desired intermediate anneal gauge is reached following the first cold rolling step, the cold rolled sheet is breakdown or first annealed in a continuous or batch anneal oven to form an intermediate cold mill anneal sheet and reduce the residual cold work and lower the earing of the aluminum sheet. The intermediate anneal is preferably a heat soak anneal. Preferably, the sheet is intermediate annealed at a minimum temperature of at least about 700° F. and more preferably at a minimum of at least about 800° F., and preferably at a maximum temperature of about 900° F. and most preferably at a maximum temperature of about 850° F. The most preferred annealing temperature is about 825° F. The annealing time is preferably a minimum of at least about 0.5 hours and is more preferably a minimum of at least about 1 hour with about 3 hours being most preferred.

Preferably, the intermediate annealed sheet is allowed to cool to a temperature less than the recrystallization temperature of the sheet prior to additional cold rolling steps. The preferred temperature for cold rolling ranges from about 75 to about 140° F. The cooling time typically is 48 hours. As will be appreciated, the sheet can be force cooled in a significantly shorter time by injecting nitrogen gas into the batch anneal oven to reduce the sheet temperatures to about 250° F. However, the sheet is preferably not subjected to solution heat treatment.

After the intermediate cold mill annealed sheet has cooled to ambient temperature, a further cold rolling step is used, as necessary, to form a further cold rolled sheet having a smaller intermediate gauge. Preferably, the intermediate gauge ranges from about 0.015 to about 0.040 inches and more preferably from about 0.020 to about 0.030 inches. Preferably, the thickness of the strip is reduced in total by less than 65%, more preferably by from about 35% to about 60%, and most preferably from about 50% to about 60% in the step. It is preferred that the total reduction be realized in two passes or less, with a single pass being preferred.

The further cold rolled sheet is annealed a second time, preferably in a continuous or batch anneal oven, to form a further intermediate cold mill annealed sheet. The anneal is preferably a heat soak anneal. Preferably, the annealing temperature ranges from about 600 to about 900° F., more preferably from about 650 to about 750° F. The most preferred temperature is about 705° F. The annealing time preferably is at least about 0.5 hrs and more preferably about 2 hrs, with about 3 hrs being most preferred.

Preferably, the further intermediate cold mill annealed sheet is allowed to cool to a temperature less than the recrystallization temperature of the sheet prior to the final cold rolling step. The preferred temperature for cold rolling ranges from about 75 to about 140° F. The cooling time typically is about 48 hours. As will be appreciated, the sheet can be force cooled in a significantly shorter time by injecting the nitrogen gas into the batch annealing oven to reduce the sheet temperatures to about 250° F. However, the sheet is preferably not subjected to solution heat treatment.

Finally, a final cold rolling step is used to impart the final properties to the sheet. Generally, the final gauge is specified and therefore the desired percent reduction for the final cold rolling step is determined. The percent reductions in the other cold rolling steps and the hot rolling step are back calculated based upon the final desired gauge. The back calculation is performed such that the total cold mill reductions before the first annealing step, between the first and second annealing steps, and after the second annealing step are each less than about 65%.

In a preferred embodiment, the total reduction to final gauge is from about 40% to 65%, more preferably from about 50% to about 60% and most preferably from about 55% to about 60% in the step. Preferably, the reduction is realized through a single pass. When the sheet is fabricated for drawn and ironed container bodies, the final gauge can be, for example, from about 0.010 to about 0.014 inches. The final cold rolling step is preferably conducted at a temperature ranging from about 75° F. to about 120° F.

The aluminum alloy sheet produced from the above-noted alloy by this process is especially useful for drawn and ironed container bodies. When the aluminum alloy sheet is to be fabricated into drawn and ironed container bodies, the alloy sheet preferably has an as-rolled yield tensile strength of at least about 38.5 ksi, more preferably at least about 39.0 ksi, and most preferably at least about 39.5 ksi. The maximum as-rolled yield tensile strength is no more than about 40.0 ksi. Preferably, the after-bake yield tensile strength is at least about 37.0 ksi, more preferably at least about 38.0 ksi, and most preferably is at least about 39.0 ksi, and preferably is not greater than about 39.5 ksi. The aluminum alloy sheet preferably has an as-rolled ultimate tensile strength of at least about 42.5 ksi, more preferably at least about 43.0 ksi and most preferably at least about 43.5 ksi and preferably less than about 44.0 ksi. The after-bake ultimate tensile strength is preferably at least about 42.5 ksi, more preferably at least about 43.0 ksi and most preferably at least about 43.5 ksi, and preferably not greater than about 44.0 ksi. Preferably, the aluminum alloy sheet has an earing of less than about 2%, more preferably less than about 1.8% and most preferably less than about 1.6%. The earing typically ranges from about 1.5% to about 1.7%. The sheet preferably has an after-bake elongation of at least about 4.5%, more preferably at least about 5.0% and most preferably at least about 5.5%. The sheet preferably has an as-rolled elongation of at least about 4.0%, more preferably at least about 4.5%, and most preferably at least about 5.0%. Further, container bodies fabricated from the alloy of the present invention have a minimum dome reversal strength of at least about 90 psi and more preferably at least about 95 psi at current commercial thickness.

In a further embodiment, the aluminum alloy composition includes the following constituents:

(i) manganese, preferably with a minimum of at least about 0.95 wt % manganese and preferably with a maximum of at most about 1.1 wt % manganese;

(ii) magnesium, preferably with a minimum of at least about 1.3 wt % magnesium and preferably with a maximum of at most about 1.5 wt % magnesium;

(iii) copper, preferably with a minimum of at least about 0.43 wt % copper and a maximum of at most about 0.50 wt % copper;

(iv) iron, preferably with a minimum of at least about 0.51 wt % iron and a maximum of at most about 0.60 wt % iron;

(v) silicon, preferably with a minimum of about 0.37 wt % silicon and a maximum of at most about 0.45 wt % silicon.

The balance of the alloy composition consists essentially of aluminum and incidental additional materials and impurities. The incidental additional materials and impurities are preferably limited to about 0.05 wt % each, and the sum total of all incidental materials and impurities preferably does not exceed about 0.15 wt %.

EXAMPLES 1–10

In order to illustrate the advantages of the present invention, a number of aluminum alloys were formed into sheets.

Four examples comparing AA 3004/3104 alloys with the alloys of the present invention are illustrated in Table I.

TABLE I

| | Composition (weight %) | | | | Hot mill Anneal | Cold mill Anneal | Secondary |
|---|---|---|---|---|---|---|---|
| Example | Mg | Mn | Cu | Fe | Temperature | Temperature | Cold Work |
| 1 (comparative) | 1.21 | 0.84 | 0.22 | 0.44 | 825° F. | 705° F. | 75% |
| 2 (comparative) | 1.28 | 0.96 | 0.21 | 0.41 | 825° F. | 705° F. | 75% |
| 3 | 1.22 | 0.83 | 0.42 | 0.35 | 825° F. | 705° F. | 64% |
| 4 | 1.31 | 0.99 | 0.41 | 0.34 | 825° F. | 705° F. | 61% |

In each example, the silicon content was between 0.18 and 0.22 and the balance of the composition was aluminum. Each alloy was continuously cast in a block caster and was then continuously hot rolled. The hot mill and intermediate cold mill anneals were each for about 3 hours. After the hot mill anneal, the sheets were cold rolled to reduce the thickness by from about 45 to 70 percent in one or more passes. After this cold rolling, the sheets were intermediate cold mill annealed at the temperature indicated.

Thereafter, the sheets were cold rolled to reduce the thickness by the indicated percentage. Table II illustrates the results of testing the processed sheets.

TABLE II

| | As-Rolled | | | | After-Bake | | |
|---|---|---|---|---|---|---|---|
| Example | UTS | YS | Elongation | Earing | UTS | YS | Elongation |
| 1 (comparative) | 41.3 | 39.3 | 3.2% | 2.2% | 40.0 | 35.2 | 4.8% |
| 2 (comparative) | 43.2 | 40.4 | 3.1% | 2.2% | 40.7 | 36.0 | 4.3% |
| 3 | 42.4 | 39.4 | 3.2% | 1.4% | 42.3 | 37.1 | 5.1% |
| 4 | 43.1 | 40.1 | 3.2% | 1.2% | 43.3 | 37.8 | 5.3% |

The ultimate tensile strength (UTS), yield strength (YS), elongation, and earing were each measured when the sheet was in the as-rolled condition. The UTS, YS and elongation were then measured after a bake treatment which consisted of heating the alloy sheet to about 400° F. for about 10 minutes.

Comparative Examples 1 and 2 illustrate that, when fabricated using a continuous caster, an AA 3004/3104 alloy composition is too weak for can-making applications. In order to achieve similar as-rolled strengths, the 3004/3104 alloy requires more cold work, and therefore, has higher earing. Further, the 3004/3104 alloy has a large drop in yield strength after the bake treatment, which can result in a low dome reversal strength for the containers.

Examples 3 and 4 illustrate alloy compositions according to the present invention. The sheets had a significantly lower drop in yield strength due to baking and therefore maintained adequate strength for can-making applications. Further, these alloy sheets maintained low earing. These examples substantiate that AA3004/3104 alloys that are processed in a continuous caster are too weak for use as containers, particularly for carbonated beverages. However, when the copper level is increased according to the present invention, the sheet has sufficient strength for forming cans.

To further illustrate the advantages of the present invention, a number of examples were prepared to demonstrate the effect of increased thermal treatment temperature, such as at temperatures taught by the prior art. These examples are illustrated in Table III.

TABLE III

| | Composition | | | | Hot mill | |
|---|---|---|---|---|---|---|
| Example | Mg | Mn | Cu | Fe | Anneal | Result |
| 5 | 1.28 | 0.98 | 0.42 | 0.35 | 1000°F. 3 hours | Unable to unwrap coils |
| 6 | 1.28 | 0.98 | 0.42 | 0.35 | 950° F. 3 hours | Unable to unwrap coils |
| 7 | 1.28 | 0.98 | 0.42 | 0.35 | 925° F. 10 hours | Unable to unwrap 4 of 5 coils |

As is illustrated in Table III, annealing temperatures at 925° F. or higher resulted in welded coils which were not able to be unwrapped for further processing. As a result, such temperatures are clearly not useful for alloy sheets according to the present invention.

Table IV illustrates the effect of increasing the iron content according to a preferred embodiment of the present invention.

TABLE IV

| | Composition (weight %) | | | | Hot mill Anneal | Intermediate Cold mill Anneal |
|---|---|---|---|---|---|---|
| Example | Mg | Mn | Cu | Fe | Temperature | Temperature |
| 8 | 1.22 | 0.83 | 0.42 | 0.38 | 825° F. | 705° F. |
| 9 | 1.31 | 0.94 | 0.42 | 0.36 | 825° F. | 705° F. |
| 10 | 1.37 | 1.12 | 0.42 | 0.55 | 825° F. | 705° F. |

In each example in addition to the listed elements, the silicon content was between 0.18 and 0.23 and the balance was essentially aluminum. Each alloy was cast in a block caster and was then continuously hot rolled. The hot mill anneal in all cases was for about 3 hours. After the hot mill anneal, the sheets were cold rolled to reduce the thickness by from about 45 to 70 percent in one or more passes. After this cold rolling, the sheets were intermediate cold mill annealed for about 3 hours at the temperatures indicated and then further cold rolled.

Table V illustrates the results of testing the foregoing aluminum alloy sheets.

TABLE V

| Example | UTS (ksi) | YS (ksi) | Elongation % | Earing % | Result |
|---|---|---|---|---|---|
| 8 | 42.3 | 37.0 | 5.0 | 1.5 | Excellent for 5.5 oz. cans |
| 9 | 43.2 | 38.2 | 4.8 | 1.6 | Made 12 oz. cans |
| 10 | 43.2 | 37.8 | 5.2 | 1.7 | Excellent for 12 oz. cans |

The ultimate tensile strength (UTS), yield strength (YS) and elongation were measured after a bake treatment which consisted of heating the alloy to about 400° F. for about 10 minutes.

Example 8 illustrates an alloy and process according to the present invention for making a sheet product which is sufficient for 5.5 ounce can bodies. By increasing the copper content and maintaining an adequate cold mill anneal temperature, sheet is produced that is excellent for the commercial production of 5.5 ounce container bodies. However, the sheet did not have sufficient formability for the commercial production of 12 ounce container bodies. Although the sheet had sufficient strength and 12 ounce container bodies were made, a commercially unacceptable number of the 12 ounce container bodies were rejected when produced on two commercial can-lines.

Example 9 is similar to Example 8, with increased magnesium and manganese; the sheet was also useful for 5.5 ounce container bodies and did produce some 12 ounce container bodies with acceptable strength. However, the 12 ounce container bodies also had a commercially unacceptable number of rejects.

Example 10 illustrates that by increasing the iron content according to the present invention, this problem can be overcome. In Example 10, the sheet material had excellent fine grain size and was used to produce 12 ounce container bodies on two commercial container lines with a commercially acceptable rate of rejection.

In an alternative embodiment of the present invention, fine grain size may be imparted to the sheet material by using a continuous intermediate cold mill anneal. In one example, an aluminum alloy sheet having the composition illustrated for Example 4 was intermediate cold mill annealed in a continuous, gas-fired furnace wherein the metal was exposed to a peak temperature of about 900° F. This treatment imparted a very fine grain size to the sheet. The sheet had an ultimate tensile strength of 45.5 ksi and 12 ounce container bodies were produced that met commercial strength requirements.

EXAMPLES 11–19

To illustrate the advantages of aluminum alloy sheet of the present invention relative to aluminum alloy sheet produced by other continuous casting and ingot casting processes, a number of aluminum alloys were formed into sheets. In the tests, six samples of 3000 series alloys produced by other continuous casting or ingot casting processes were compared with three 3000 series alloys produced according to the method of the present invention. The results are presented in Tables VI (A) and (B).

TABLE VI (A)

| | Alloy | | Composition | | | | As rolled | | | | After Bake | | |
|---|---|---|---|---|---|---|---|---|---|---|---|---|---|
| Sample # | Designation | Si | Cu | Fe | Mn | Mg | UTS | YTS | Elong. | Earing % | UTS | YTS | EL |
| 11 | 5349D | 0.38 | 0.43 | 0.28 | 1.14 | 1.81 | 42.8 | 39.5 | 3.2 | 1.4 | 42.5 | 37.2 | 5.6 |
| 12 | 3304B | 0.19 | 0.37 | 0.41 | 0.81 | 1.2 | 42.3 | 38.8 | 4.1 | 1.7 | 42.3 | 37.1 | 5.1 |
| 13 | 3304C | 0.21 | 0.55 | 0.41 | 1.04 | 1.3 | 43.9 | 39.9 | 4.4 | 1.8 | 43.1 | 37.8 | 5.3 |
| 14 | 3304F | 0.21 | 0.55 | 0.41 | 0.83 | 1.36 | 43.3 | 39.1 | 4.4 | 1.8 | 42.6 | 37.3 | 5.3 |
| 15 | 3304CSV | 0.38 | 0.57 | 0.47 | 1.05 | 1.33 | 43.5 | 40.1 | 4.59 | 2.6 | 43.3 | 37.6 | 5.87 |
| 16 | 3304CSV(mod) | 0.38 | 0.57 | 0.46 | 1.04 | 1.35 | 42.8 | 38.9 | 4.99 | 1.7 | 42 | 36.3 | 5.58 |
| 17 | 3304CJ(mod) | 0.42 | 0.598 | 0.5 | 1.06 | 1.42 | 43.2 | 39.3 | 4.7 | 1.6 | 42.7 | 37 | 5.8 |
| 18 | 3304CJ(mod) | 0.42 | 0.59 | 0.5 | 1.03 | 1.448 | 43.25 | 39.6 | 4.6 | 1.7 | 42.7 | 37 | 5.7 |
| 19 | Comparative | AA3004 | | | | | 44.1 | 40.08 | 6.74 | 1.8 | 41.1 | 37.28 | 5.88 |

TABLE VI(B)

| Sample # | Hot mill anneal temp | Total cold roll red % to (first) anneal point | Cold mill first anneal temp | Total cold roll red % from first anneal point to second anneal point | Cold mill second anneal temp | Total final cold mill red % |
|---|---|---|---|---|---|---|
| 11 | 825 | 74 | N/A | N/A | 705 | 45 |
| 12 | 825 | 53 | N/A | N/A | 705 | 65 |
| 13 | 825 | 75 | N/A | N/A | 705 | 60 |
| 14 | 825 | 75 | N/A | N/A | 705 | 60 |
| 15 | 825 | 74 | N/A | N/A | 705 | 60 |
| 16 | N/A | 41 | 825 | 60 | 705 | 55 |
| 17 | N/A | 33 | 825 | 60 | 705 | 55 |
| 18 | N/A | 42 | 825 | 60 | 705 | 55 |
| 19 | 620F self anneal | 91% total cold work to flnish gauge | | | | |

The balance of the composition in each sample was aluminum. Samples 11–18 were continuously cast in a block caster and then continuously hot rolled. Samples 11–15 were annealed, cold rolled, annealed a second time, and cold rolled to form the aluminum alloy sheet. In accordance with the process of the present invention, samples 16–18 were cold rolled, annealed, cold rolled, annealed, and cold rolled to form the aluminum alloy sheet. The various anneals were each for about 3 hours. Samples 11, 13–16, and 19 were fabricated into cans on conventional canmaking equipment and the canmaking behavior of the samples determined.

Table VII illustrates the results of testing the processed sheets.

TABLE VII

| | BODYSTOCK PRODUCT PROGRESSION | | | | |
|---|---|---|---|---|---|
| SAMPLE | ALLOY | SCORING | BUCKLE | NECKING/FLANGE | EARING |
| 11 | 5349D | Severe | Fair | Very Poor | 1.7% |
| 13 | 3304C | Severe | Good | Poor | 2.4% |
| 14 | 3304F | Fair | Fair | Fair | 2.4% |
| 15 | 3304 CSV | Good | Good | Fair | 2.6% |
| 16 | 3304 (MOD) | Good | Good | Good | 1.7% |
| 19 | Comparative | | | | 2.0% |

Samples 11 and 13–14 produced scored cans and demonstrated poor necking/flange behavior. Samples 11 and 14 further demonstrated a fair buckle strength while sample 13 demonstrated poor earing. Sample 14 exhibited fair qualities in can scoring, buckle strength, and necking/flange behavior but a very poor earing. In sharp contrast, sample 16, which was fabricated by the process of the present invention had a low degree of can scoring and acceptable buckle strength, necking/flange behavior, and earing. Sample 19, which was produced by ingot casting techniques and is considered high quality canmaking stock, in fact had a higher earing than sample 16.

Samples 15 and 16 were compared to sample 19, which is high quality canmaking sheet prepared by ingot casting techniques. The various sheet samples were formed into cans. The results are presented in Table VIII below.

TABLE VIII

| | | BODYMAKER | | | After-Deco/IBO Ovens | | |
|---|---|---|---|---|---|---|---|
| SAMPLE | ALLOY | UTS (ksi) | YTS (ksi) | Elong. (%) | UTS (ksi) | YTS (ksi) | Elong. (%) |
| 15 | 3304 CSV | 51.10 | 47.50 | 0.90 | 47.00 | 40.10 | 2.90 |
| 16 | 3304 CSV (modified) | 48.95 | 45.66 | 1.08 | 44.34 | 38.43 | 3.76 |
| 19 (Comparative) | 3004/3104 | 48.96 | 45.06 | 1.63 | 43.25 | 38.67 | 3.82 |

The ultimate tensile strength (UTS), yield tensile strength (YTS), and elongation (Elong) were measured after the container exited the bodymaker and after the container exited the deco step. The deco step or after bake step included heating the alloy sheet to about 400° F. for about 10 minutes. The bodymaker samples are the mechanical properties of the container thick wall in a transverse direction.

Sample 15 exhibited a greater UTS and YTS and lower elongation than sample 16 after the bodymaker and the after-deco step. Sample 16 exhibited more elongation than sample 15, especially after the deco step. In fact, the properties of sample 16 mirrored the properties of sample 19, which, as noted above, is considered high quality canmaking stock, in both UTS and YTS after the bodymaker and deco step and in elongation after the deco step. The differences in physical properties of samples 16 and 19 in each of these categories were within testing error of one another. Sample 19, however, did have a measurably higher elongation than sample 16 after the bodymaker. Nonetheless, sample 16 has canmaking properties similar to sample 19. This is a surprising and unexpected result for continuously cast aluminum alloy sheet which has significantly more cold work than ingot cast sheet.

While various embodiments of the present invention have been described in detail, it is apparent that modifications and adaptations of those embodiments will occur to those skilled in the art. It is to be expressly understood that such modifications and adaptations are within the spirit and scope of the present invention.

What is claimed is:

1. A method for fabricating an aluminum sheet product, comprising the steps of:

(a) continuously casting an aluminum alloy melt to form a cast strip;

(b) hot rolling the cast strip to form a hot rolled sheet;

(c) cold rolling said hot rolled sheet to form a cold rolled sheet;

(d) annealing said cold rolled sheet to form an intermediate cold mill annealed sheet;

(e) cold rolling said intermediate cold mill annealed sheet to form a further cold rolled sheet;

(f) annealing the further cold rolled sheet to form a further cold mill annealed sheet; and (g) cold rolling the further cold mill annealed sheet to form aluminum alloy sheet.

2. A method as recited in claim 1, wherein said hot rolling step (b) is performed in the absence of homogenization.

3. A method as recited in claim 1, wherein said hot rolling step (b) reduces the gauge of said cast strip by at least about 70 percent.

4. A method as recited in claim 1, wherein said cold rolling step (c) reduces the gauge of said hot rolled sheet by less than about 65%.

5. A method as recited in claim 1, wherein said cold rolling step (c) is performed in the absence of annealing of the hot rolled sheet.

6. A method as recited in claim 1, wherein in said cold rolling step (e) the gauge of the intermediate cold mill annealed sheet is reduced by no more than about 65%.

7. A method as recited in claim 1, wherein the temperature in said annealing step (d) ranges from about 700 to about 900° F.

8. A method as recited in claim 1, wherein said aluminum alloy melt comprises at least about 75 weight percent scrap.

9. A method as recited in claim 1, wherein said aluminum alloy melt comprises:

(i) from about 0.7 to about 1.3 weight percent manganese, (ii) from about 1 to about 1.6 weight percent magnesium, (iii) from about 0.3 to about 0.6 weight percent copper, (iv) no more than about 0.50 weight percent silicon, and (v) from about 0.3 to about 0.7 weight percent iron, the balance being aluminum and incidental additional materials and impurities.

10. A method as recited in claim 1, wherein the cold rolling step (g) reduces the gauge of the further cold mill annealed sheet by less than about 75%.

11. A method for fabricating an aluminum sheet product, comprising the steps of:

(a) continuously strip casting an aluminum alloy melt to form a cast strip;

(b) hot rolling said cast strip in the absence of homogenization of said cast strip to form a hot rolled sheet;

(c) cold rolling said hot rolled sheet to form a cold rolled sheet;

(d) annealing said cold rolled sheet to form an intermediate cold mill annealed sheet;

(e) cold rolling said intermediate cold mill annealed sheet to form a further cold rolled sheet, wherein the reduction in gauge of the intermediate cold mill annealed sheet is less than about 65%;

(f) annealing the further cold rolled sheet to form a further cold mill annealed sheet, and (g) cold rolling said further cold mill annealed sheet to form aluminum alloy sheet, wherein the reduction in gauge of the further cold mill annealed sheet in cold rolling step (g) is less than about 65%.

12. A method as recited in claim 11, wherein said aluminum alloy melt comprises:

(i) from about 0.7 to about 1.3 weight percent manganese, (ii) from about 1 to about 1.6 weight percent magnesium, (iii)no more than about 0.5 weight percent silicon, and (iv) from about 0.3 to about 0.7 weight percent iron, the balance being aluminum and incidental additional materials and impurities.

13. A method as recited in claim 11, wherein the thickness of the aluminum alloy sheet is at least about 40% of the thickness of the hot rolled sheet.

14. A method as recited in claim 11, wherein the thickness of the hot rolled sheet is no more than about 30% of the thickness of said cast strip.

15. A method for fabricating an aluminum sheet product, comprising the steps of:

(a) continuously casting an aluminum alloy melt to form a cast strip;

(b) cold rolling said cast strip to form a cold rolled sheet;

(c) annealing said cold rolled sheet to form an intermediate cold mill annealed sheet, wherein the temperature in said annealing step (c) ranges from about 700 to about 900° F.;

(d) cold rolling said intermediate cold mill annealed sheet to form a further cold rolled sheet;

(e) annealing the further cold rolled sheet to form a further cold mill annealed sheet; and (f) cold rolling the further cold mill annealed sheet to form aluminum alloy sheet.

16. A method as recited in claim 15, further comprising hot rolling the cast strip and wherein said hot rolling step is performed in the absence of homogenization.

17. A method as recited in claim 16, wherein said hot rolling step reduces the gauge of said cast strip by at least about 70 percent.

18. A method as recited in claim 16, wherein said cold rolling step (b) reduces the gauge of said hot rolled sheet by less than about 65%.

19. A method as recited in claim 16, wherein said cold rolling step (b) is performed in the absence of annealing of the hot rolled sheet.

20. A method as recited in claim 15, wherein in said cold rolling step (d) the gauge of the intermediate cold mill annealed sheet is reduced by no more than about 65%.

21. A method as recited in claim 15, wherein said aluminum alloy melt comprises at least about 75 weight percent scrap.

22. A method as recited in claim 15, wherein said aluminum alloy melt comprises:

(i) from about 0.7 to about 1.3 weight percent manganese, (ii) from about 1 to about 1.6 weight percent magnesium, (iii) from about 0.3 to about 0.6 weight percent copper, (iv) no more than about 0.50 weight percent silicon, and (v) from about 0.3 to about 0.7 weight percent iron, the balance being aluminum and incidental additional materials and impurities.

23. A method as recited in claim 15, wherein the cold rolling step (f) reduces the gauge of the further cold mill annealed sheet by less than about 75%.

24. A method for fabricating an aluminum sheet product, comprising:

(a) continuously casting an aluminum alloy melt to form a cast strip;

(b) cold rolling said cast strip in the absence of homogenization to form a cold rolled sheet;

(c) annealing said cold roller sheet to form and intermediate cold mill annealed sheet;

(d) cold rolling said intermediate cold mill annealed sheet to form a further cold rolled sheet;

(e) annealing the further cold rolled sheet to form a further cold mill annealed sheet; and (f) cold rolling said further cold mill annealed sheet to form an aluminum alloy sheet.

* * * * *